US009010353B2

(12) United States Patent
Salihbegovic

(10) Patent No.: US 9,010,353 B2
(45) Date of Patent: Apr. 21, 2015

(54) GAS LIFT VALVE HAVING EDGE-WELDED BELLOWS AND CAPTIVE SLIDING SEAL

(75) Inventor: Zlatko Salihbegovic, New Iberia, LA (US)

(73) Assignee: Weatherford Technology Holdings, LLC, Houston, TX (US)

( * ) Notice: Subject to any disclaimer, the term of this patent is extended or adjusted under 35 U.S.C. 154(b) by 474 days.

(21) Appl. No.: 13/198,468

(22) Filed: Aug. 4, 2011

(65) Prior Publication Data

US 2013/0032226 A1 Feb. 7, 2013

(51) Int. Cl.
*F04D 1/08* (2006.01)
*E21B 43/12* (2006.01)

(52) U.S. Cl.
CPC ..... *E21B 43/123* (2013.01)

(58) Field of Classification Search
USPC ..... 137/81.1, 81.2, 155; 251/61–61.2, 324; 166/319, 372
See application file for complete search history.

(56) References Cited

U.S. PATENT DOCUMENTS

| | | | | | |
|---|---|---|---|---|---|
| 2,668,553 | A | * | 2/1954 | Howard et al. | 137/155 |
| 2,761,465 | A | * | 9/1956 | Garrett et al. | 137/155 |
| 2,797,700 | A | * | 7/1957 | McGowen, Jr | 137/155 |
| RE25,292 | E | * | 12/1962 | Dudley | 137/155 |
| 3,530,770 | A | * | 9/1970 | Abercrombie et al. | 92/42 |
| 5,421,241 | A | | 6/1995 | Terral | |
| 5,465,747 | A | * | 11/1995 | de Almeida | 137/155 |
| 5,662,335 | A | | 9/1997 | Larsen | |
| 6,182,684 | B1 | | 2/2001 | Frankenberg | |
| 6,202,984 | B1 | | 3/2001 | Fichtner et al. | |
| 6,364,640 | B1 | | 4/2002 | Nishio et al. | |
| 6,491,105 | B2 | | 12/2002 | Holt, Jr. | |
| 6,546,738 | B2 | | 4/2003 | Sekiya et al. | |
| 6,929,034 | B1 | | 8/2005 | Larsen et al. | |
| 6,932,581 | B2 | | 8/2005 | Messick | |
| 7,228,909 | B2 | | 6/2007 | Schmidt et al. | |
| 7,370,706 | B2 | | 5/2008 | Becker et al. | |
| 7,373,972 | B2 | | 5/2008 | Ocalan | |
| 2003/0111231 | A1 | | 6/2003 | Faustinelli | |
| 2007/0074872 | A1 | | 4/2007 | Du et al. | |

(Continued)

OTHER PUBLICATIONS

"Edge Welded Bellows," VACOM Vakuum Komponenten & Messtechnik GmbH, obtained from www.vacom-vacuum.com, 13 pages.

(Continued)

*Primary Examiner* — Craig Schneider
*Assistant Examiner* — Ian Paquette
(74) *Attorney, Agent, or Firm* — Wong, Cabello, Lutsch, Rutherford & Brucculeri, LLP

(57) ABSTRACT

A gas lift apparatus has a gas lift valve that disposes in a mandrel. A housing of the valve has a chamber, and a seat disposes between the inlet and outlet. A piston movably disposed in the housing has one end exposed to the chamber. A distal end can selectively seal with the seat to close the valve. A first edge-welded bellows disposed on the piston separates the inlet and chamber pressures and can fully compress to a stacked height when the distal end of the piston seals with the seat. A dynamic seal can be achieved at closing by using a captive sliding seal between the piston's distal end and the seat. A second edge-welded bellows can also be disposed on the piston, and the two bellows can operate in tandem. Oil filing the interiors and the passage can move from one bellows to the other to transfer the pressure differential between the inlet and the chamber pressures. The second bellows fully compresses to a stacked height and stops opening of the valve.

39 Claims, 8 Drawing Sheets

(56) References Cited

U.S. PATENT DOCUMENTS

| | | | | |
|---|---|---|---|---|
| 2007/0227739 | A1 | 10/2007 | Becker et al. | |
| 2008/0217356 | A1* | 9/2008 | Strecker et al. | 222/1 |
| 2009/0044947 | A1 | 2/2009 | White et al. | |
| 2010/0096142 | A1 | 4/2010 | Randazzo | |
| 2010/0155079 | A1 | 6/2010 | Stokka et al. | |
| 2010/0193717 | A1* | 8/2010 | Tanikawa et al. | 251/63.5 |
| 2010/0224807 | A1* | 9/2010 | Brizes | 251/63.6 |
| 2011/0067879 | A1 | 3/2011 | Kleppa et al. | |
| 2011/0127043 | A1 | 6/2011 | Hahn et al. | |
| 2012/0241023 | A1* | 9/2012 | Ikeda et al. | 137/487 |

OTHER PUBLICATIONS

"Gaslift valve design addresses long-term well integrity need," Published Feb. 1, 2011 www.offshore-mag.com, Petroleum Technology Company, obtained from www.ptc.as/web, generated on Jun. 24, 2011, 3 pages.

"Edge Welded Bellows for Lift Valves, ROVs, Precision Downhole Tools," JPT Online, Official Publication of the Society of Petroleum Engineers, Jun. 2, 2011, obtained from www.jptonline.org, generated on Jun. 24, 2011, 3 pages.

"Petroleum Technology Company: SafeLift," obtained from www.ptc.as, undated, 3 pages.

"RF Series Production Pressure-Operated Valves," Weatherford International, Ltd. (c) 2008, brochure No. 1477.00, 2 pages.

"R-Series IPO Gas Lift Valves," Weatherford International, Ltd. (c) 2005 brochure No. 1475.00, 3 pages.

"Tubing-Retrievable (Conventional) Injection Pressure-Operated Gas-Lift Valves: C Series," Weatherford International, Ltd. (c) 2005 brochure No. 1489.00, 3 pages.

"Tubing-Retrievable, Injection-Pressure, Pilot-Operated Gas-Lift Valves: CPV Series," Weatherford International, Ltd. (c) 2005 brochure No. 1491.00, 3 pages.

"XLG Series Side Pocket Mandrel," Schlumberger, obtained from www.slb.com/xlift, brochure 06-AL-073, Aug. 2006, 2 pages.

"XLift: High-pressure gas lift system," Schlumberger, obtained from www.slb.com/artificiallift, brochure No. 06-AL-064, Jul. 2006, 6 pages.

Partial European Search Report in counterpart EP Appl. 12179046, dated Jan. 23, 2015.

* cited by examiner

GAS LIFT VALVE HAVING EDGE-WELDED BELLOWS AND CAPTIVE SLIDING SEAL

BACKGROUND

To obtain hydrocarbon fluids from an earth formation, a wellbore is drilled into an area of interest within a formation. The wellbore may then be "completed" by inserting casing in the wellbore and setting the casing using cement. Alternatively, the wellbore may remain uncased as an "open hole"), or it may be only partially cased. Regardless of the form of the wellbore, production tubing is run into the wellbore to convey production fluid (e.g., hydrocarbon fluid, which may also include water) to the surface.

Often, pressure within the wellbore is insufficient to cause the production fluid to naturally rise through the production tubing to the surface. In these cases, an artificial lift system can be used to carry the production fluid to the surface. One type of artificial lift system is a gas lift system, of which there are two primary: tubing-retrievable gas lift systems and wireline-retrievable gas lift systems. Each type of gas lift system uses several gas lift valves spaced along the production tubing. The gas lift valves allow gas to flow from the annulus into the production tubing so the gas can lift production fluid in the production tubing. Yet, the gas lift valves prevent fluid to flow from the production tubing into the annulus.

A typical wireline-retrievable gas lift system 10 is shown in FIG. 1. Operators inject compressed gas G into the annulus 22 between a production tubing string 20 and the casing 24 within a cased wellbore 26. A valve system 12 supplies the injection gas G from the surface and allows produced fluid to exit the gas lift system 10.

Side pocket mandrels 30 spaced along the production string 20 hold gas lift valves 40 within side pockets 32. As noted previously, the gas lift valves 40 are one-way valves that allow gas flow from the annulus 22 into the production string 20 and to prevent gas flow from the production string 20 into the annulus 22.

A production packer 14 located on the production string 20 forces the flow of production fluid P from a formation up through the production string 20 instead of up through the annulus 22. Additionally, the production packer 14 forces the gas flow from the annulus 22 into the production string 20 through the gas lift valves 40.

In operation, the production fluid P flows from the formation into the wellbore 26 through casing perforations 28 and then flows into the production tubing string 20. When it is desired to lift the production fluid P, compressed gas G is introduced into the annulus 22, and the gas G enters from the annulus 22 through ports 34 in the mandrel's side pockets 32. Disposed inside the side pockets 32, the gas lift valves 40 control the flow of injected gas I into the production string 20. As the injected gas I rises to the surface, it helps to lift the production fluid P up the production string 20 to the surface.

Gas lift valves 40 have been used for many years to inject compressed gas into oil and gas wells to assist in the production to the surface. The valves 40 use metal bellows to convert pressure into movement. Injected gas acts on the bellows to open the valve 40, and the gas passes through a valve mechanism into the tubing string. As differential pressure is reduced on the bellows, the valve 40 can close.

Two types of gas lift valves 40 use bellows. One type uses a non-gas charged, atmospheric bellows and requires a spring to close the valve mechanism. The other type of valve 40 uses an internal gas charge, usually nitrogen, in a volume dome to provide a closing force on the bellows. In both valve configurations, pressure differential on the bellows from injected high-pressure gas opens the valve mechanism. In the case of a valve having the non-gas charged bellows, the atmospheric bellows is subjected to high differential pressures when the valve 40 is installed in a well and can be exposed to high operating gas injection pressure. By contrast, a valve having the gas-charged bellows is subject to high internal bellows pressure during setting and prior to installation. Yet, once the gas-charged valve is installed, the differential pressure across the bellows is less than in the non-gas charged bellows during operation of the valve.

Prior art gas lift valves 40*a-b* having gas-charged bellows are shown in FIGS. 2A-2B. Each of the gas lift valves 40*a-b* has upper and lower seals 44*a-b* separating a valve port 46, which is in communication with injection gas ports 48. A valve piston 52 is biased closed by a gas charge dome 50 and a bellows assembly (i.e., convoluted bellows 56 in FIG. 2A or edge-welded bellows system 57 in FIG. 2B). At its distal end, the valve piston 52 moves relative to a valve seat 54 at the valve port 46 in response to pressure on the bellows 56 from the gas charge dome 50. A predetermined gas charge is applied to the dome 50 and bellows assembly (i.e., 56 or 57) biases the valve piston 52 against the valve seat 54 and close the valve port 46.

A check valve 58 in the gas-lift valves 40 is positioned downstream from the valve piston 52, valve seat 54, and valve port 46. The check valve 58 keeps flow from the production string (not shown) from going through the injection ports 48 and back into the casing (annulus) through the valve port 46. Yet, the check valve 58 allows injected gas from the valve port 46 to pass out the gas injection ports 48.

The bellows 56 on the valve 40*a* in FIG. 2A is a convoluted bellows. Although a spring-activated gas lift valve may be available for standard sizes and capable of higher pressures, such a bellows-activated gas lift valve 40*a* with a convoluted bellows is not available for standard sizes of 1" and 1.5", while being capable of operating pressures higher than 2000-2500 PSI range. Instead, existing gas lift valves 40*a* using convoluted bellows are rated to a maximum operating injection pressure of 2000-2500 PSI.

As a result, such a valve 40*a* is not capable of reaching high operating pressures. If exposed to higher pressures, the valve's convoluted bellows 56 would fail. For example, the bellows 56 may snake by forming a wave when exposed to high differential internal pressure, or the bellows 56 may split the convolutions by flattening when exposed to high external pressures. Finally, rapid pressure changes can contract and expand the bellows until the bellow's material fails due to fatigue.

Although a working pressure no higher than 2000-25000 PSI may be acceptable in some application, operators want to use gas lift system in higher working pressure of up to 5000-6000 PSI, for example. Unfortunately, high differential pressure across a bellows during operation reduces its cycle life. Therefore, existing gas lift valves and bellows are not designed to operate with set pressures or in operating pressures in excess of 2000 PSI without severe failure risks.

As one exception, the XLift gas lift valve available from Schlumberger has a bellows system for operating at high pressures. An example of this bellows system 57 is shown on the gas lift valve 40*b* of FIG. 2B. The edge-welded bellows system 57 is similar to that disclosed in U.S. Pat. No. 5,662,335. As shown, two sets 60*a-b* of dual bellows each include a seal bellows 62 and a counter bellows 64. The counter bellows 64 equalizes pressure exerted on the seal bellows 62 by delivering pressure of the injection gas to the oil in the system.

During operation, the valve piston 52 with its tungsten carbide ball on its distal end contacts the venturi seat 54, which acts as a positive stop for the gas lift valve 40*b*. None of the bellows 62, 64 of the bellows system 57 fully compresses. In the end, the arrangement of multiple bellows 62, 64 in the two sets 60*a-b* allow the gas lift valve to operate at higher pressures. Due to the requirements of the bellows system 57, however, the gas lift valve 40*b* must at least have a nominal size of 1.75-in. This requires the gas lift valve 40*b* to be used in a larger, custom designed gas lift mandrel, namely the XLG side pocket mandrel available from Schlumberger. Additionally, the complexity of the bellows system 57 has obvious disadvantages in the construction and operation of the gas lift valve 40*b*.

The subject matter of the present disclosure is directed to overcoming, or at least reducing the effects of, one or more of the problems set forth above.

SUMMARY

An apparatus for gas lift of production fluid in a production string has a gas lift valve that disposes in a mandrel downhole. The valve has a housing with a chamber, an inlet, and an outlet. A seat is disposed in the housing between the inlet and the outlet, and a piston is movably disposed in the housing relative to the seat for opening and closing the valve. The piston's proximal end is exposed to the chamber, while the piston's distal end can selectively seal with the seat to close fluid communication from the inlet to the outlet.

The seat and the piston's distal end can engage with a captive sliding seal during operation of the valve. In one arrangement, the seat is an inner cylindrical wall of the housing, and the piston's distal end has a captive sliding seal disposed thereabout that engages the wall when the distal end is inserted through the seat during closure of the valve. In another arrangement, the wall and seal configuration are reversed so that the piston's distal end has an external surface that engages a captive sliding seal on the housing when moved relative thereto. Different types of captive sliding seals can be used, having elastomeric biasing elements or spring-loaded basing elements.

To control movement of the piston, an edge-welded bellows is disposed on the piston and separates inlet pressure at the inlet from chamber pressure at the chamber. The first edge-welded bellows fully compresses to a stacked height when the piston's distal end seals with the seat. In this way, the stacked edge-welded bellows stops movement of the piston's distal end inside the seat so there is no need for a mechanical stop to limit the piston's movement as conventionally required. Consequently, a more dynamic seal can be achieved at closing as noted above.

Another edge-welded bellows can also be disposed on the piston and can separate the inlet pressure from the chamber pressure. For example, the two bellows can have interiors communicating with one another via an internal passage in the piston. The two bellows operate in tandem with one extending when the other contracts and vice versa. An incompressible fluid, such as silicon oil, fills the interiors and the passage and can move from one bellows to the other to transfer the pressure differential between the inlet pressure and the chamber pressure. In contrast to the first bellows, this second bellows fully compresses to a stacked height when the distal end is distanced away from with the seat. This stops movement of the distal end away from the seat during opening and stops further extension of the first bellows.

The foregoing summary is not intended to summarize each potential embodiment or every aspect of the present disclosure.

DETAILED DESCRIPTION

Figure 1:
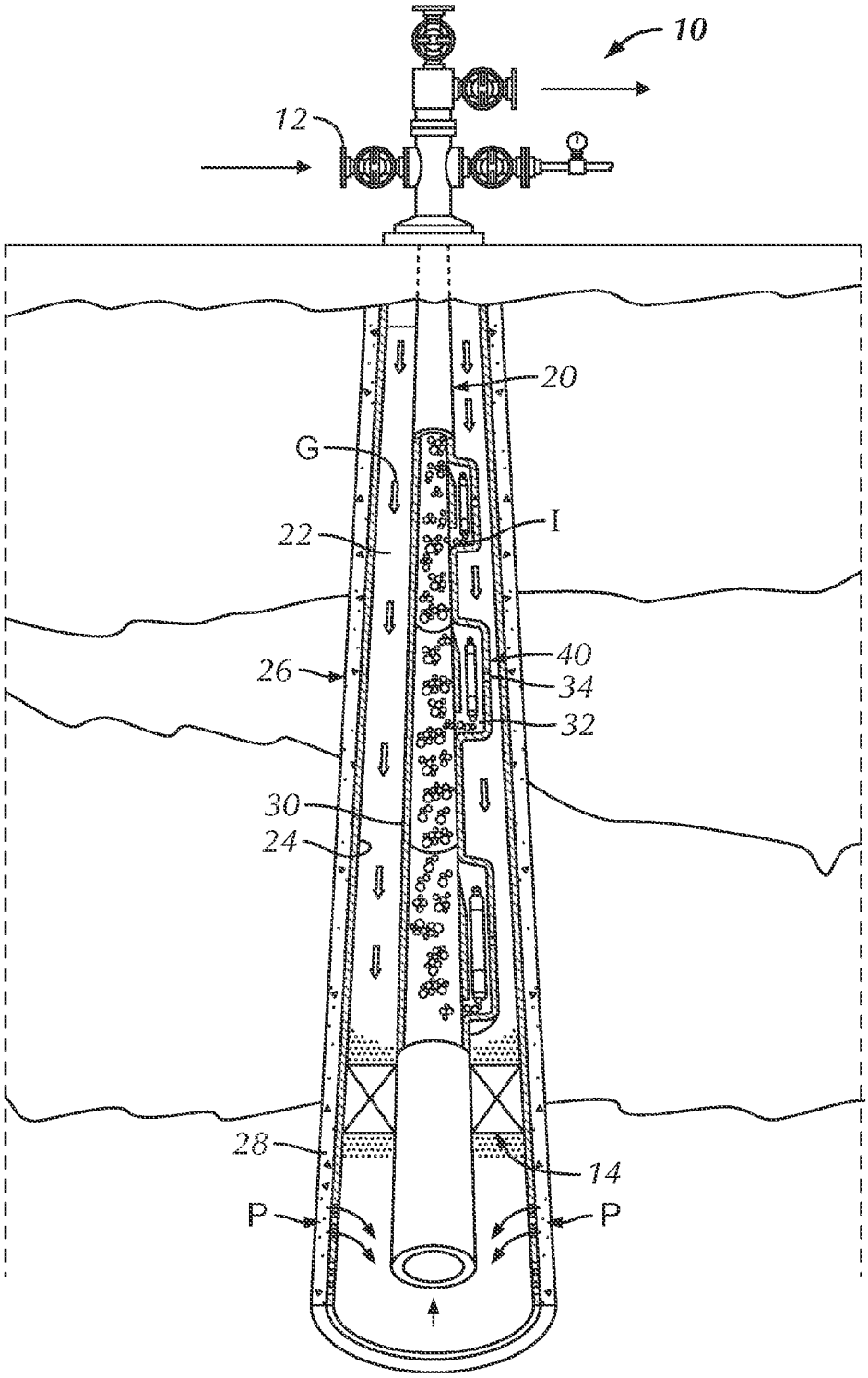
FIG. 1 (Prior Art)
FIG. 1 illustrates a gas lift system.
Figure 2A:
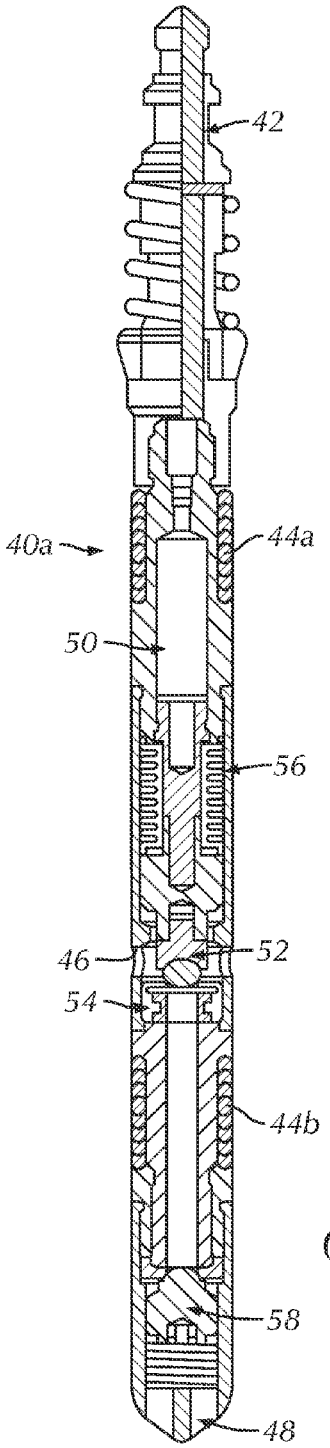
FIG. 2A (Prior Art)
FIGS. 2A-2B illustrate gas lift valves according to the prior art.
Figure 2B:
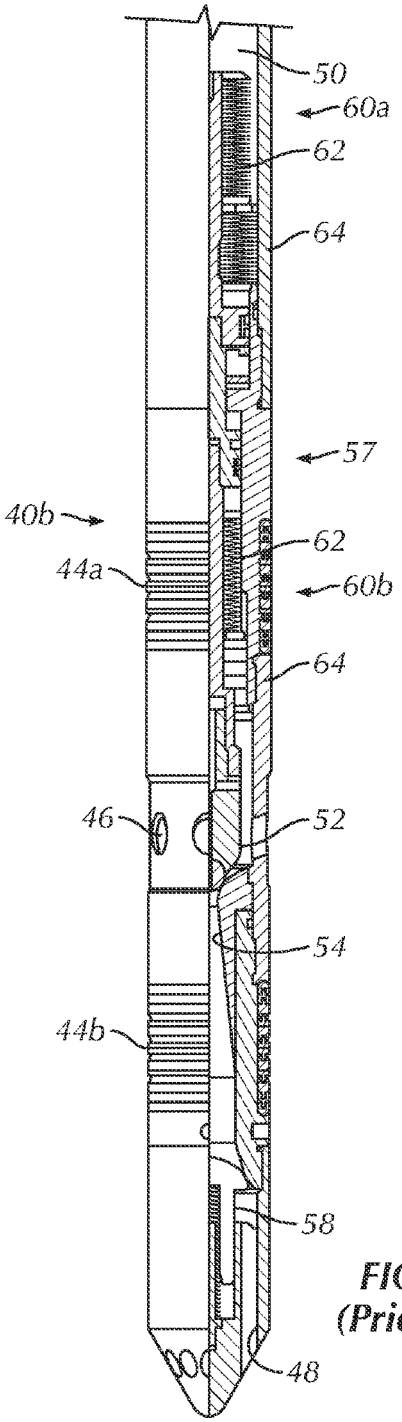
FIG. 2B (Prior Art)

A. Gas Lift Valve Having Single Edge-Welded Bellows and Captive Sliding Seal Referring to FIG. 3, a gas lift valve 100 has a housing 110 that sets in an appropriate mandrel (not shown). In general, the gas lift valve 100 can be a tubing-retrievable or a wireline-retrievable gas lift valve used in an appropriate mandrel. Shown primarily here as wireline-retrievable, the housing 110 has seals 114*a-b* to isolate fluid communication of injected gas from a port (not shown) on the mandrel into a valve port 116 of the valve 100. (Various components of the valve 100, such as a latch connected to the top end, are not shown, but would be present, as one skilled in the art would be appreciated.)

Internally, a dome chamber 120 and an edge-welded bellows 160 bias a valve piston 130 and control the flow of the injected gas from the valve port 116 to injection ports 118. The dome chamber 120 holds a compressed gas, typically nitrogen, which is filled through a port 113 in a top member 112. This port 113 typically has a core valve (not shown) for filing the chamber 120 and typically has an additional tail plug (not shown) installed during assembly.

Figure 4:
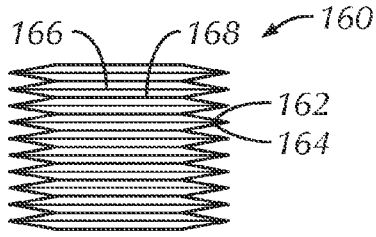
FIG. 4 shows an edge-welded bellows according to the present disclosure.

The bellows 160 separates the compressed gas in the dome chamber 120 from communicating with the valve port 116 and injection port 118 so pressure can be maintained in the chamber 120. As shown in FIG. 4, an example of the edge-welded bellows 160 for the gas lift valve has several stamped diaphragms 162 and 164 weld together. These stamped diaphragms 162 and 164 are made from metal sheeting using hydraulic stamping techniques. The thickness, shape, and material of these stamped diaphragms 162 and 164 can be configured to suite the pressure, stroke length, spring rate, temperature, and other factors of the application at hand. Various ripple profiles and the diameters of the inside and outside edges 166 and 168 of the stamped diaphragms 162 and 164 can dictate the performance of the bellows 160 so that they are preferably designed using known techniques for the desired application.

These stamped diaphragms 162 and 164 are stacked back-to-back (male to female) and are welded together at inside and outside diameters 166 and 168 using plasma, laser, arc, or electron beam welding. The upper and lower ends on the bellows 160 can have end plates or flanges welded thereto, or the ends of the bellows 160 can be directly affixed to portions of the piston 130 and housing 110, as shown in FIG. 3.

Figure 3:
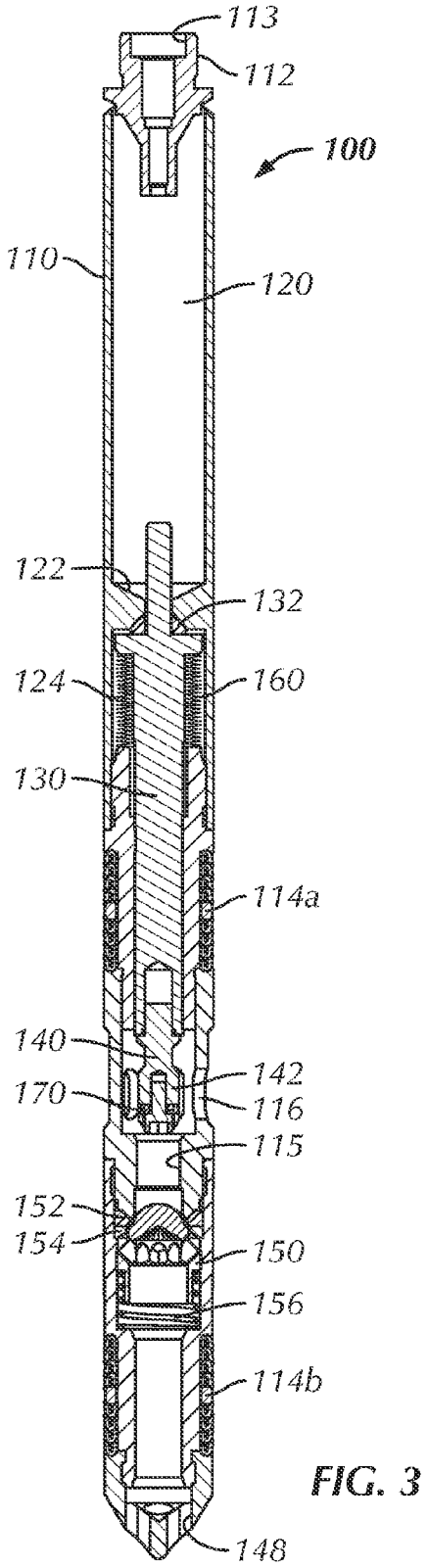
FIG. 3 illustrates a cross-section of a gas lift valve according to the present disclosure having a single edge-welded bellow.

Looking at the valve piston 130 in more detail in FIG. 3, an upper seal 132 can engage an upper seat 122 of the dome chamber 120 when the piston 130 is at its pinnacle position (i.e., fully biased open). The upper seal 132 is preferably made of a metal material, such as copper, which is less hard than the upper seat 122.

The valve piston 130 can be grooved or slotted along portion of its length to fit in complementary grooves or slots inside the housing 110 to prevent rotation of the valve piston 130. Opposite the bellows 160, the valve piston 130 has a distal end 140 that moves relative to an inner seating surface 115 of the housing 110. The distal end 140 has an outer surface 142, which can be cylindrical in shape to match the seating surface 115 with a close clearance. The housing's inner surface 115 and the distal end's outer surface 142 are disposed axially along the axis of the valve 100 so that the outer surface 142 can slide with tight clearance relative to the inside surface 115 of the housing 110. A suitable clearance for the two surfaces 115 and 142 would be about ±0.002-inch, although other clearances could be used for a given implementation.

To control fluid flow, a captive sliding seal 170 on the piston's distal end 140 engages or disengages the surface 115 to close and open communication from the valve port 116 to the injection ports 118. The captive sliding seal 170 is installed in a groove around the outside surface 142 of the distal end 140 and moves with the end 140 relative to the internal seating surface 115 of the housing 110 near the inlet 116. (Further details of the captive sliding seal 170 are discussed below with reference to FIGS. 6A-6B.)

Any injected gas passing through the seating surface 115 when the distal end 140 is distanced opened therefrom can overcome the bias of a reverse check valve 150 and exit the injection ports 118 to enter the production tubing for the gas lift operation. As is typical, the check valve 150 can be a dart valve with ports 151. A spring 156 biases the check valve 150 toward a seat, which has an elastomeric component 152 and a retainer 154, although other types of seals could be used.

The bellows 160 is disposed on the valve piston 130 in an ancillary chamber 124 separated from the dome chamber 120 by the chamber seat 122. The valve 100 uses this edge-welded bellow 160 as the membrane between the dome chamber 120 and the annulus injection pressure that opens the valve 100. Contrary to the conventional convoluted bellows used in the art, the bellows 160 is an edge-welded bellows, as discussed below. Moreover, unlike the typical bellows that fully expands when a gas lift valve is closed, the edge-welded bellows 160 is fully compressed when valve 100 is closed, and the bellows 160 goes to expanded state as the valve 100 is being opened by the differential between injection and tubing pressures.

The single edge-welded bellows 140 moves the piston 130 depending on the pressure difference between the dome pressure and injection pressure. In particular, pressure in the dome chamber 120 acts on the bellows' outside surface while injection pressure acts internally. If there is no injection pressure, the valve 100 is in the closed position, and the bellows 160 is compressed completely to its solid height (like a fully compressed spring). This is unlike the standard convoluted bellows, which is in an expanded state when the gas lift valve is closed.

As noted above, the bellows 160 is configured to fully compress so that the piston's distal end 140 engages in the sealing surface 115, closing the valve 100. When compressed gas from the casing-tubing annulus (not illustrated) is injected from the surface, the gas enters the inlet 116 during operation of the valve 100. The compressed gas travels internally in the space between the housing 110 and the piston 130 and enters the interior of the bellows 160. Here, the compressed gas acts against the internal surfaces of the bellows 160, pushing the convolutions against the external dome chamber pressure inside the bellows 160. Meanwhile, pressurized gas and any oil or the like in the dome 120 provides a counteracting force on the external surface of the bellows 160.

Figure 5A:
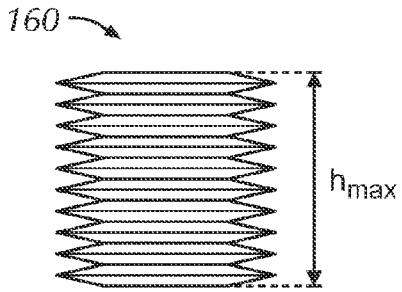
FIGS. 5A-5C shows the edge-welded bellows in three states.

Eventually, a pressure balance (minus tubing pressure effect) for the bellows 160 is reached when the internal injection pressure reaches the external dome chamber's pressure. At this point, the bellows 160 starts to expand, and the valve piston 130 moves toward an open position as injection pressure increases. At some point, when the force of compressed gas inside the bellows 160 is large enough, the bellows 160 fully extends. (FIG. 5A shows the edge-welded bellows 160 in a fully extended state with a height $h_{max}$.)

With the bellows 160 fully extended, the upper seal 132 on the piston 130 engages the chamber's seat 122. This prevents further extension of the bellows 160 and further movement of the piston 130. When the bellows 160 extends, the piston 130 moves away from the sealing surface 115, allowing the compressed gas from the inlet 116 to exit the ports 118. This condition is shown in FIG. 3.

The dome chamber 120 is filled with appropriate amount of silicone oil. When the valve 100 is in a vertical working position, the bellow's outside surface is submerged in silicone oil. The silicone oil protects the bellows 160 from internal-injection pressure and prevents valve chatter due to any non-uniform injection flow or pressure. When injection pressure increases and the bellows 160 expands completely, the copper seal 132 on the valve piston 120 reaches the chamber's seat 122. Expansion of the bellows 160 stops and silicone oil is trapped in the volume between the bellow's outside dimension and the dome's internal diameter. In this open condition, the copper seal 132 provides a bellows expansion stop, and the incompressible oil prevents bellows convolution deformations and failure.

Figure 5B:
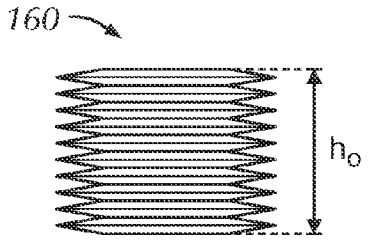

When less compressed gas from the casing-tubing annulus enters the valve 100, the external and internal pressure difference on the bellows 160 may cause the bellows to partially contract the bellows 160 and move the piston's distal end 140 toward the sealing surface 115. (FIG. 5B shows the edge-welded bellows 160 in an intermediate state with a contracted height $h_0$.)

When even less or no gas enters the valve 100, the external and internal pressure difference on the metal bellows 160 fully compresses the bellows 160, and the piston's distal end 140 moves against the sealing surface 115. When the bellows 160 fully compresses, the piston's seal 170 engages the seating surface 115, thereby preventing fluid from passing through the valve 100 to the outlet 118. This represents the "closed" condition of the valve 100.

Figure 5C:
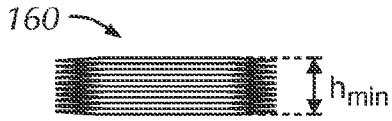

When the edge-welded bellows 160 is fully compressed, the bellows 160 reverts to its solid, stack height. (FIG. 5C shows the edge-welded bellows 160 in a fully compressed state with a stack height $h_{min}$.) The full compression protects the bellows 160 from deformation caused by the external dome pressure when the gas lift valve 100 is closed. With the bellows 160 compressed to its solid stack height, there is no room for the bellow's convolutions to deform and fail. The pressure reaches between the bellow's external surfaces since no sealing is provided when convolutions are compressed against each other. Yet, there is no room for the convolutions to deform and yield. Thus, the fully compressing bellows 160 can have a very high-pressure rating.

During operation of the valve 100, the bellows 160 stays close to pressure balance so the convolutions are protected from overstressing. It is believed that the gas lift valve 100 of FIG. 3 may be able to operate at least in pressures as high as 2,500 PSI. By using the single edge-welded bellows 160 with the captive sliding seal 170, the gas lift valve 100 can still have 1" and 1.5" valve diameter. Moreover, the captive sliding seal 170 is not sensitive to explosive decompression.

It should be noted that due to the tubing pressure effect, the bellows 160 may not be perfectly pressure balanced. However, any pressure difference is not very large, and the pressure difference for various seal diameters and tubing pressure combinations may be expected to range within about 20%. This means that the injection pressure acting on the bellow's surface area minus the seat's ID surface area may be higher than the dome pressure in chamber 120.

In the gas-lift valve 100, the bellows 160 itself acts as a stop, which is reaches its stack height and keeps the piston's distal end 140 from inserting further in the seat 115. Historically, gas lift valves use a tungsten carbide ball and seat to open and close flow through the valve as noted previously. Engagement of the ball with the seat acts as the "stop" for the piston in conventional gas lift valves. Since the edge-welded bellows 160 acts as the "stop," the disclosed gas lift valve 100 can use the captive sliding seal 170, which is a different type of sealing mechanism than typically used.

B. Captive Sliding Seal Arrangement

Figure 6A:
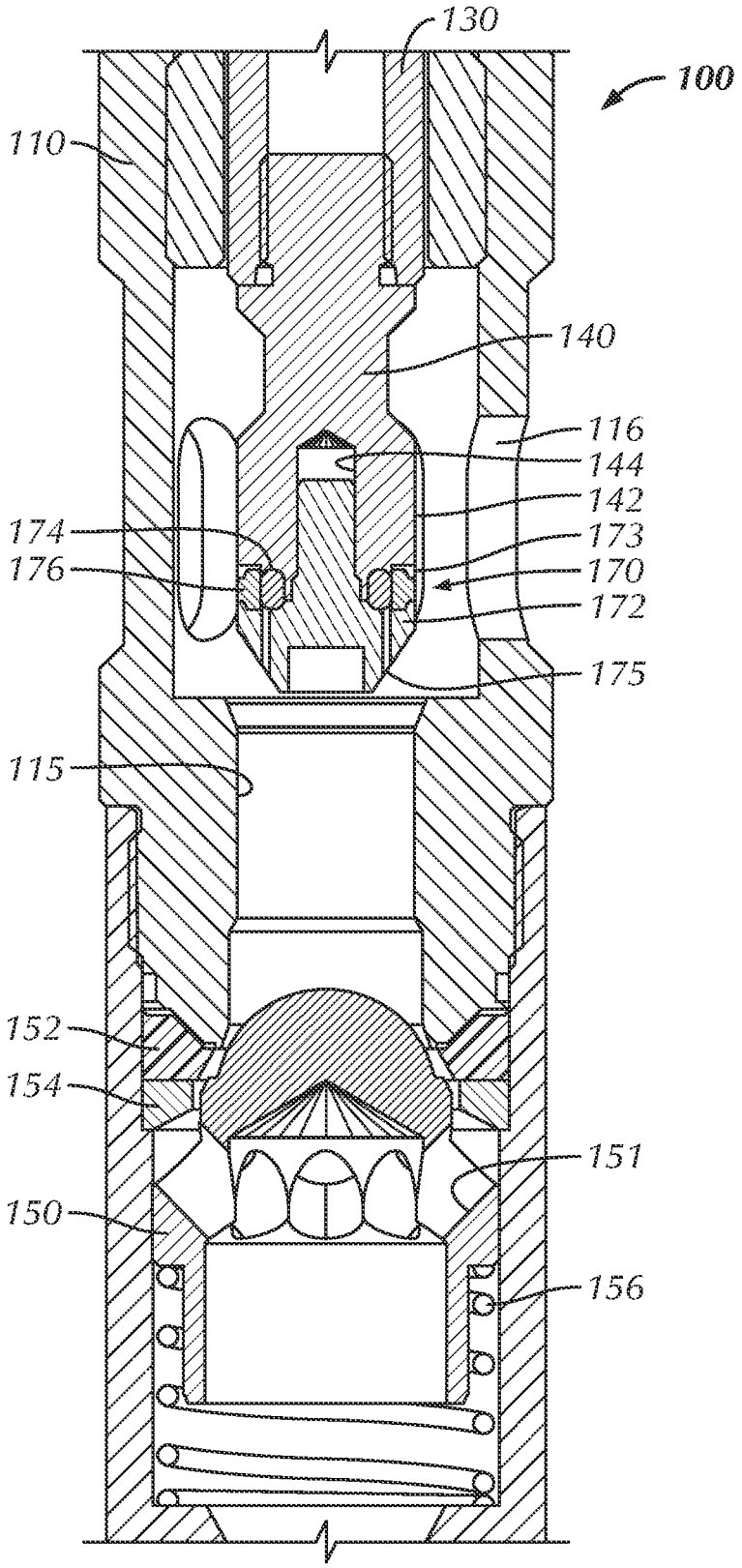
FIGS. 6A-6B illustrates portion of the gas lift valve, showing the valve member in stages of sealing.
Figure 6B:
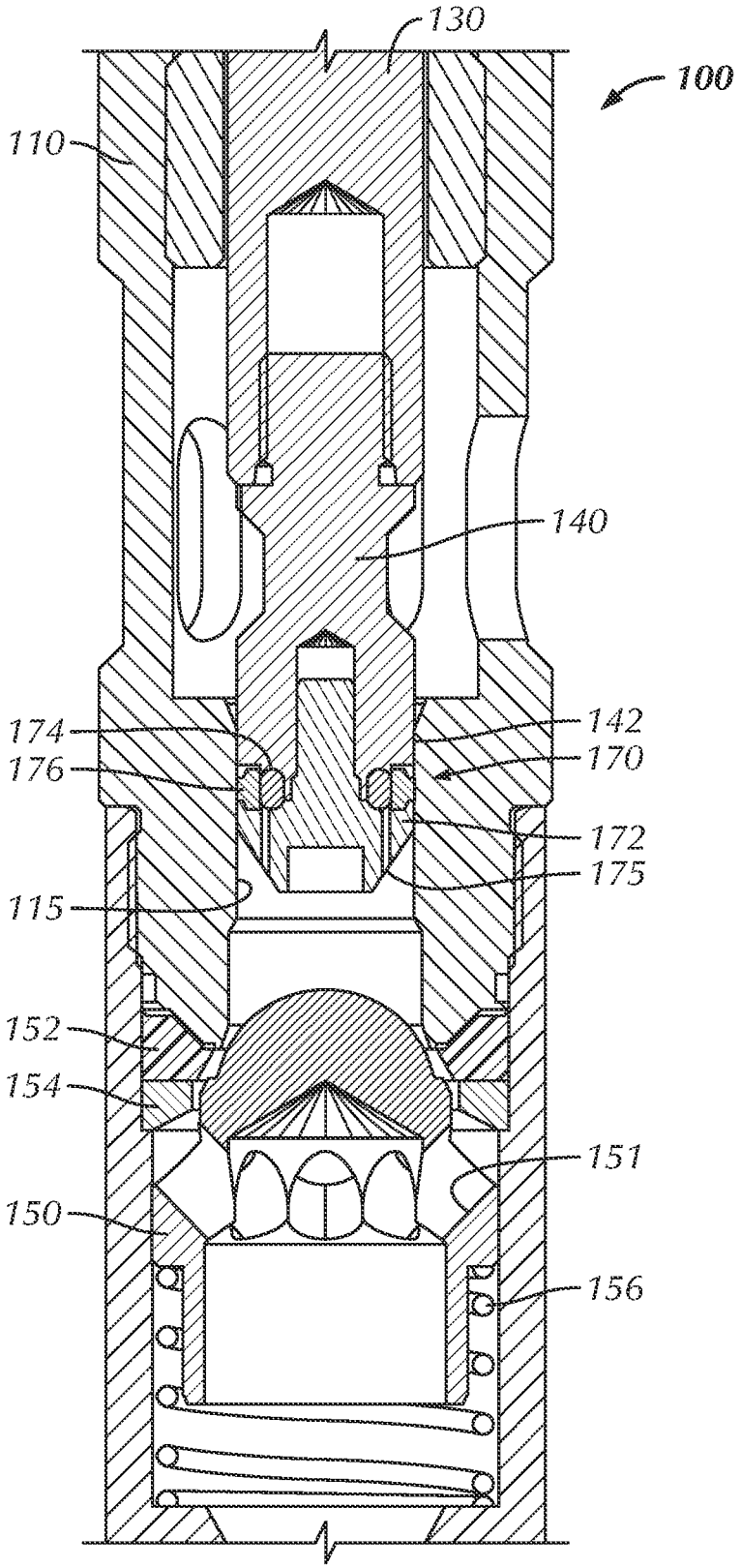

To that end, discussion now turns to the captive sliding seal 170 as shown in FIGS. 6A-6B. The captive sliding seal 170 includes a cap 172 affixed in the opening 144 on the piston's distal end 140. The cap 172 holds a sealing element 176 and a biasing element 174 on the end 140. The biasing element 174 is an O-ring seal, which can be composed of a suitable elastomer for the application. The sealing element 176 can be a ring composed of a polymer, such as polytetrafluoroethylene (PTFE), Teflon®, or the like. (TEFLON is a registered trademark of E. I. Du Pont De Nemours and Company Corporation.)

The biasing element 174 is held captive in a groove 173 behind the sealing element 176. In this way, the sealing element 176 is energized by the biasing element 174 and extends outward from the distal end's outer surface 142 so it can transversely engage the seating surface 115. When engaged with the side of the sealing surface 115, the sealing element 176 as shown in FIG. 6B creates a seal as it engages the surface 115 and is biased by the biasing element 174.

The groove 173 helps anchor the elements 174 and 176 to prevent the seal 170 from displacing during opening of the valve (100). Channels 175 in the cap 172 communicate from the end of the cap 172 to an area of the groove 173 between the biasing and sealing elements 174 and 176. The channels 175 are intended to equalize the pressure on the elements 174 and 176 and may be optional depending on the implementation. As will be appreciated, differential pressure across the seal 170 can be significant and appropriate anchoring of the seal 170 can be necessary for proper functioning.

C. Alternative Captive Sliding Seal Arrangements

Figure 7A:
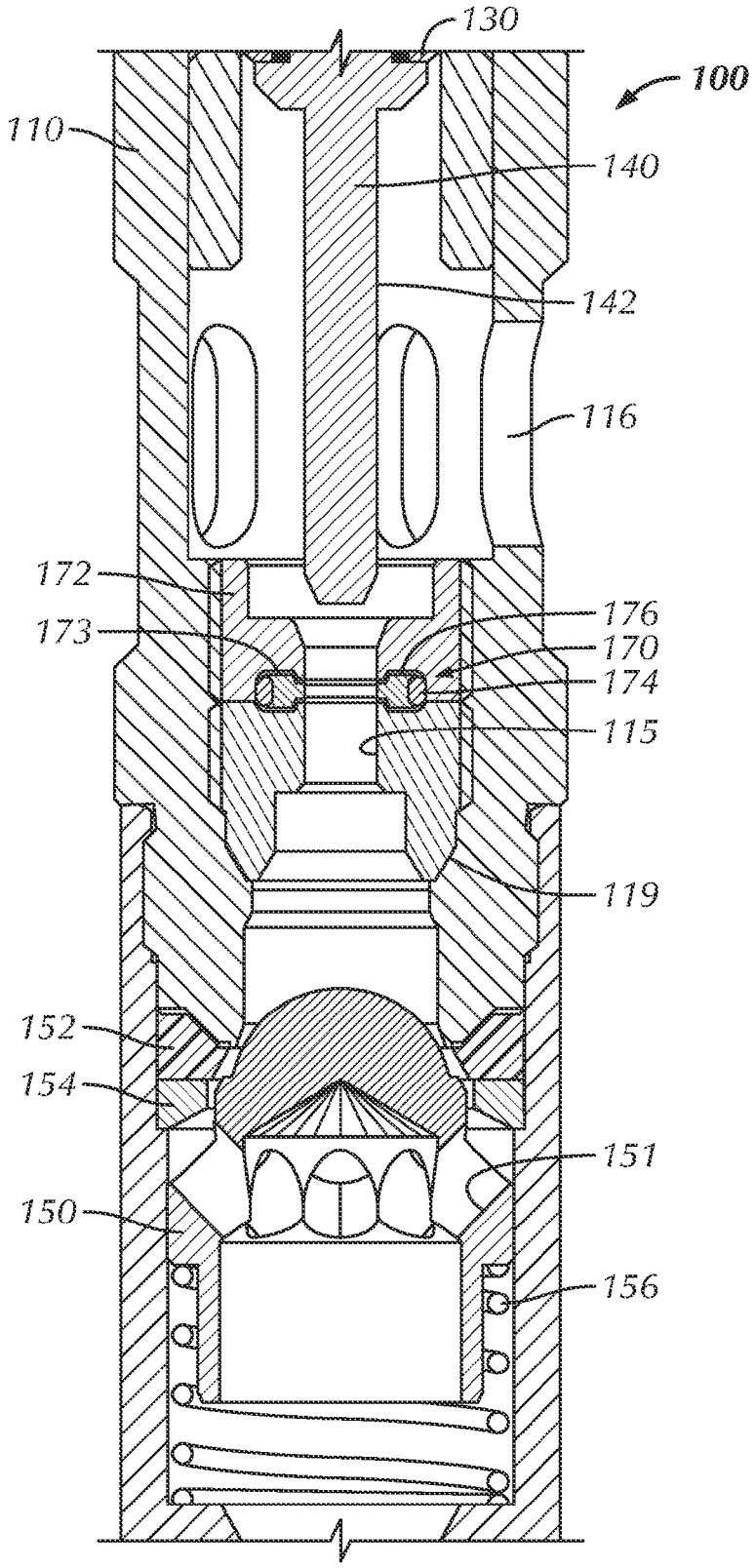
FIG. 7A illustrates portion of the gas lift valve, showing a reverse sealing arrangement than that shown in FIGS. 6A-6B.

As shown in FIG. 7A, the captive sliding seal 170 can be configured in a reverse arrangement on the gas lift valve 100. As shown here, the cap 172 is a ring element that threads into the housing 110 at the sealing surface 115. (Other means for holding the cap 172 could be used, such as external retention pins or the like.) The sealing surface 115 may be an integral part of the housing 110 as before, or a base element 119 as shown can thread into the housing 110 to provide the surface 115 and engage the cap 172.

The cap 172 holds the biasing element 174 and the sealing element 176 captive in a groove 173. (Here, the groove 173 is formed between the cap 172 and the base element 119.) For its part, the piston's distal end 140 has an outer surface 142, which can be cylindrical and can have a tight clearance to the internal diameter of the housing's sealing surface 115. When the distal end 140 inserts into the sealing surface 115 during valve closure, the captive sliding seal 170 engages the distal end's outer surface 142 to seal off fluid flow from the inlet ports 116 to the check valve 150. This arrangement is especially useful when the valve's performance requires a relatively small diameter for the distal end 140 because the small diameter would make retaining biasing and sealing elements on the distal end 140 problematic.

Figure 7B:
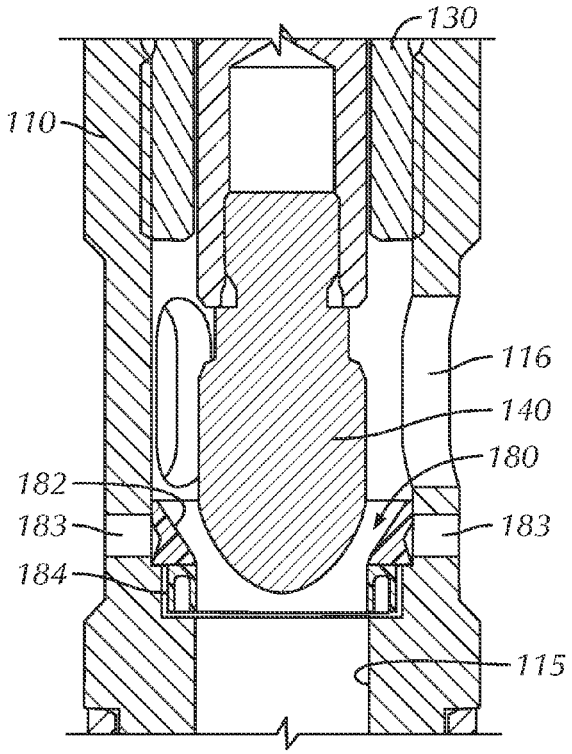
FIG. 7B illustrates portion of the gas lift valve, showing another sealing arrangement having a spring-loaded cup seal.

Another captive sealing arrangement is shown in FIG. 7B, which illustrates portion of the gas lift valve 100. Instead of the distal end 140 on the piston 130 having the sealing elements, a captive sealing seat 180 is disposed in the housing 110 between the inlet 116 and the housing's inner surface 115. The distal end 140 has an outer surface 142, which can be cylindrical in shape to match the seating surface 115 with a close clearance. As the valve 100 operates, the distal end 140 attached to the piston 130 can travel through the captive sealing seat 180 to open and close the valve 100, and the end's outer surface 142 engages the captive sealing seat 180.

For its part, the captive sealing seat 180 includes a retaining ring 182 and an energized lip seal 184. The retaining ring 182 can be composed of non-elastomeric material, such as PTFE or metal. As shown, the retaining ring 182 can be held in the housing 110 with retention pins (not shown) inserted externally through retention holes 183 in the housing. Of course, other means known in the art could be used to retain the ring 182. For example, the ring 182 may thread into the housing 110 to hole the seal 184 captive.

The energized lip seal 184 can be a spring-loaded cup seal disposed in a rod and piston seal configuration. The resiliency of the seal 184 therefore acts transversely to the piston's longitudinal axis. In this way, the seal 184 presses outward into the valve's seating surface 115 and acts transversely to the seating direction of the distal end 170 as shown in FIG. 7B. Due to the flow and pressure that the seal 184 may be subjected to during operation, the shape and geometry of the seal 184 is preferably configured, as much as possible, to avoid failure. All the same, the seal 184 offers another type of sealing configuration for the sliding captive seal of the present disclosure.

Figure 7C:
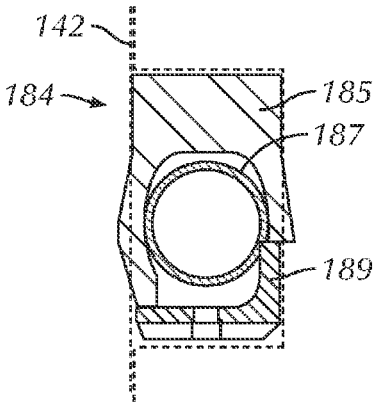
FIG. 7C is a detailed view of a spring-loaded cup seal having a lip biased transversely to the valve's axis.

FIG. 7C shows one arrangement of a spring-loaded cup seal for the seal 184 on the sealing arrangement of FIG. 7B. As shown, the spring-loaded cup seal 184 can have a jacket 185, a coil spring 187, and a hat ring 189. The jacket 185 and hat ring 186 are both preferably composed of non-elastomeric materials, and the coil spring 187 is preferably composed of corrosive resistant metal. The seal's internal lip is preferably thick to prevent possible oscillation when exposed to high flow rates of gas or water through the valve 100. Further details of such a captive sealing arrangement having such a spring-loaded cup seal and the like are provided in co-pending U.S. patent application Ser. No. 13/027,676, entitled "Self-Boosting, Non-Elastomeric Resilient Seal for Check Seal" and filed 15 Feb. 2011, which is incorporated herein by reference in its entirety.

As will be appreciated, the sealing arrangement of FIGS. 7B-7C can also be reversed with proper configuration of the components. In this way, the piston's distal end 140 can having the captive sliding seal 180 disposed thereon not unlike the arrangement of FIGS. 6A-6B, while the housing's sealing surface 115 can be cylindrical and lack a seal.

The sealing arrangements of FIGS. 6A-6B and 7A-7C for the captive sliding seals 170/180 allow the distal end 140 to slide with the axial movement of the piston 130 through the valve's surrounding surface 115 when opening and closing the valve. The captive sliding seals 170/180 can avoid problems that conventional seals experience from explosive decompression. In addition, the captive sliding seals 170/180 (especially the seal arrangement of FIGS. 6A-6B) can resist erosion that may occur when the valve 100 is operated. For redundancy, both the piston's distal end 140 and the housing's sealing surface 115 can have a captive sliding seal, as long as the two seals are arranged so as not to engage one another when the valve 100 is fully closed. Moreover, either the distal end 140 or the surface 115 may have more than one captive sliding seal disclosed herein.

D. Gas Lift Valve Having Dual Edge-Welded Bellows and Captive Sliding Seal

Figure 8:
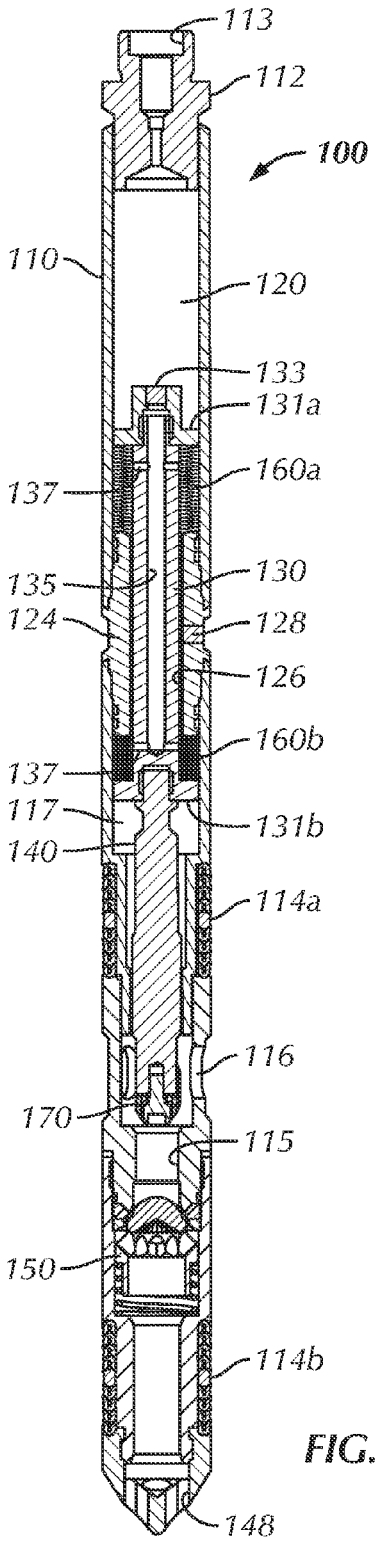
FIG. 8 illustrates a cross-section of a gas lift valve according to the present disclosure having dual edge-welded bellows.
Figure 9A:
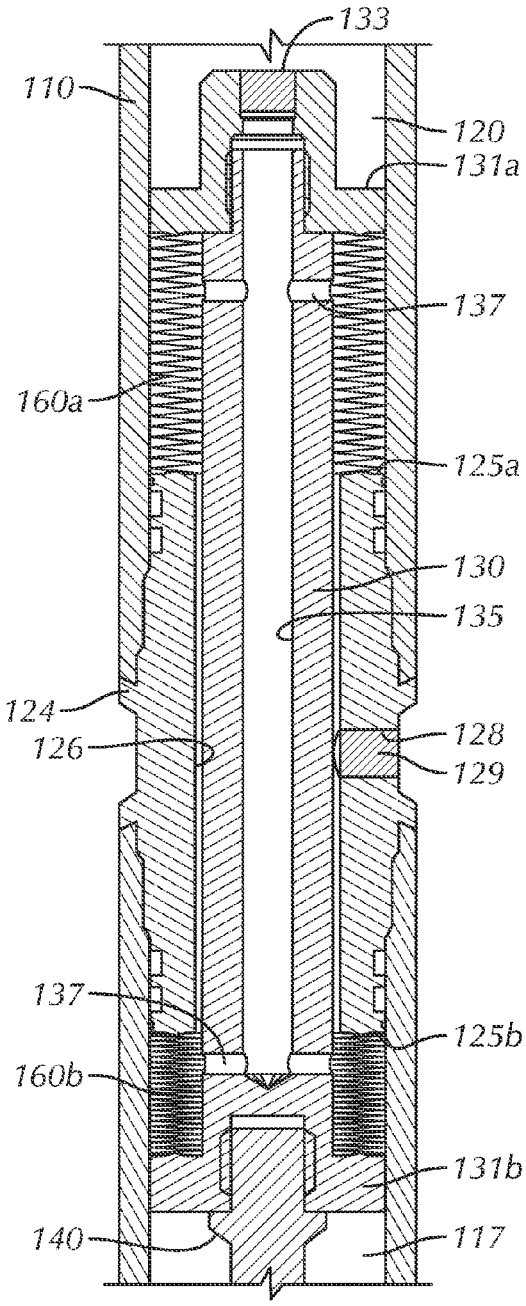
FIGS. 9A-9B illustrates portion of the gas lift valve, showing the dual bellows during stages of operation.
Figure 9B:
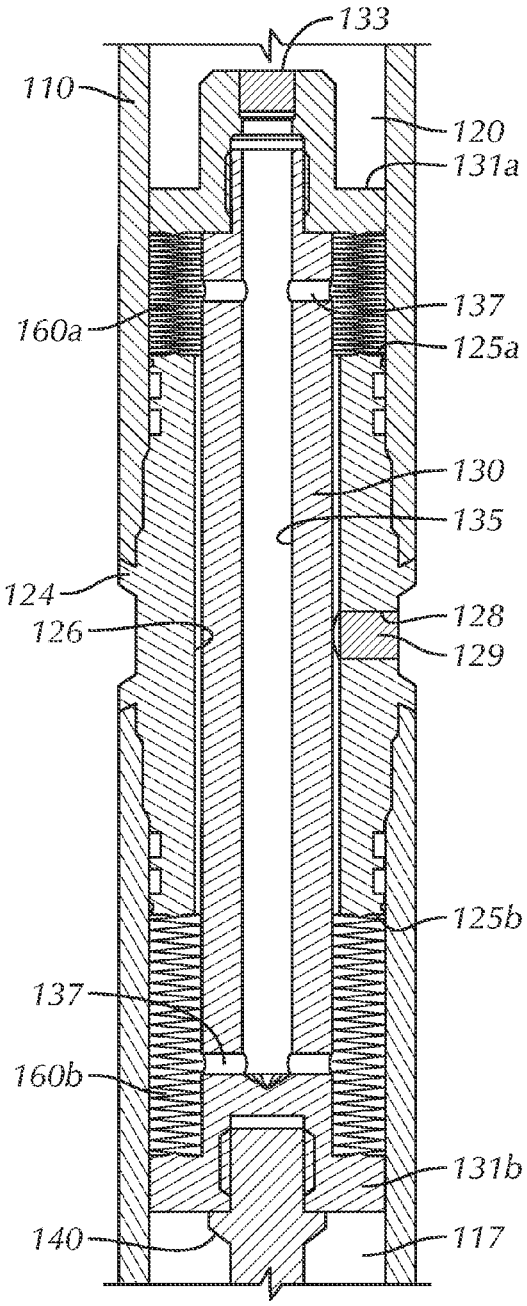

FIG. 8 illustrates another gas lift valve 100 according to the present disclosure. In contrast to the previous arrangement, the valve 100 has dual edge-welded bellows 160*a-b* disposed on the piston 130. Additionally, the piston 130 defines an internal passage having a main passage 135 and ancillary passages 137, which interconnect the interiors of the bellows 160*a-b* as discussed later. (FIGS. 9A-9B illustrate portion of the gas lift valve 100, showing the dual bellows 160*a-b* during stages of operation.)

As before, the gas lift valve 100 has seals 114*a-b* on the housing 110 to isolate fluid communication of injected gas into a valve port 116 of the valve 100. A dome chamber 120 and the dual edge-welded bellows 160*a-b* then bias a valve piston 130 and control the flow of the injected gas from the valve port 116 to injection ports 118. The dome chamber 120 holds a compressed gas, typically nitrogen, which is filled through a port 113 in a top member 112 and later sealed with a plug (not shown). The two bellows 160*a-b* separate the compressed gas in the chamber 120 from communicating with the valve port 116 and injection port 118 so pressure can be maintained in the chamber 120. During valve operation, both bellows 160*a-b* are very close to internal/external pressure balance, which is helpful to protect the bellows 160*a-b*.

Looking in particular at the valve piston 130, an upper connector or shoulder 131*a* on the piston 130 has one end of the upper bellows 160*a* affixed thereto; the other end of the upper bellows 160*a* affixes to the top surface or end wall on an intermediate body 124. This upper connector 131*a* and the exterior of the upper bellows 160*a* are exposed to pressure in the dome chamber 120. The valve piston 130 also has a lower connector or shoulder 131*b* to which one end of the lower bellows 160*b* affixes; the other end of the lower bellows 160*b* affixes to the bottom surface or end wall on the intermediate body 124. The lower connector 131*b* and the exterior of the lower bellows 160*b* are exposed to pressure in an ancillary chamber 117. Pressure acting outside the upper bellows 160*a* transfers via the piston's passages 135 and 137 to the interior of the lower bellows 160*b*. The reverse is also true.

The valve piston 130 also has a distal end 140 that moves relative to an inner seating surface 115 of the housing 110. As before, a captive sliding seal 170 on the distal end 140 engages or disengages the surface 115 to close and open communication from the valve port 116 to the injection ports 118. (Although shown with the captive sliding seal 170 on the distal end 140, this valve 100 of FIG. 8 can have any of the other seal arrangements disclosed herein.) Any injected gas passing through the seating surface 115 when the distal end 140 is distanced opened therefrom can overcome the bias of a reverse check valve 150 and exit the injection ports 118 to enter the production tubing for the gas lift operation.

Turning in particular to FIGS. 9A-9B, the bellows 160*a-b* and the piston 130 are shown relative to the intermediate body 124 when the valve 100 is fully open (FIG. 9A) and fully closed (FIG. 9B). As shown when the valve 100 is open in FIG. 9A, the lower bellows 160*b* is configured to fully compress when the distal end (140) disengages from the sealing surface (115), opening the valve 100. Contrariwise, the upper below 160*a* is configured to extend when the valve is open. As shown when the valve 100 is closed in FIG. 9B, the upper bellows 160*a* is configured to fully compress when the distal end (140) engages in the sealing surface (115), closing the valve 100. Contrariwise, the lower bellows 160*b* is configured to extend when the valve is closed.

For assembly, one end of each bellows 160*a-b* welds to the bellow connector 131*a-b*, which has a surface machined to match the bellow's convolution geometry. Opposite ends of each bellow 160*a-b* are welded to mating surfaces 125*a-b* on the intermediate body 124, which has its surfaces 125*a-b* machined to match the bellow's convolution geometry. The matching surfaces 125*a-b* on the body 124 and the surfaces on the connectors 131*a-b* allow the bellows 160*a-b* to be compressed to solid height against the surfaces for full contact without deformation/damage to bellows' convolutions. In other words, the bottom and top surfaces 125*a-b* of the intermediate body 124 match the shape of an edge-welded diaphragm of the bellows 160*a-b*, and the surfaces of the caps 131*a-b* also match the shape of an edge-welded diaphragm of the bellows 160*a-b*. Thus, when the bellows 160*a-b* are fully compressed to their stack height, the surfaces and caps 131*a-b* will not tend to deform the bellows 160*a-b*.

Once the bellows 160*a-b* are welded to the mating parts, the bellows 160*a-b* are filled with an incompressible fluid, such as silicone oil. The lower bellow 160*a* is fully compressed during the filling. Once filled, plugs 129 and 133 are installed respectively in opening 128 in the intermediate body 124 and in the opening 133 on the upper connector 131*a*. Once filled, oil can then flow between the upper and lower bellows 160*a-b* depending on which bellow pressure is acting through the communication passages 135 and 137 in the piston 130.

The chamber 120 is charged with compressed gas, such as nitrogen, at a desired high pressure through the end piece (112), whose opening (113) is plugged after filing. With only the dome pressure, the pressure in the chamber 120 acts on the upper bellow's external surface, causing it to fully compress (FIG. 9B) to its solid length (similar to a fully compressed spring) when injection pressure is not present.

With the dome pressure acting alone, the seal piston 130 moves the distal end 140 toward the seating surface (115), and the captive sliding seal (170) engages the surface (115) as discussed previously. There is no flow through the valve 100 at this point. The lower bellow 160*b* remains extended to its free length, and the internal oil has pumped from the upper bellow 160*a* to the lower bellow 160*b* through the piston's passages 135 and 137.

The pressure difference on the bellows 160*a-b* fully compresses the upper bellows 160*a* and fully extend the lower bellows 160*b* to move the piston's distal end 140 against the sealing surface (115). The captive sliding seal 170 engages seating surface (115), thereby preventing injection gas from passing through the valve 100 to the outlet (118). This represents the "closed" condition of the valve 100.

When the upper bellows 160*a* is fully compressed, the bellows 160*a* reverts to its solid height, and no more oil flow occurs once the upper bellow 160*a* is fully compressed. The full compression protects the bellows 160*a* from deformation caused by the external dome pressure when the gas lift valve 100 is closed. Moreover, the compressed upper bellows 160*a* acts as a stop to the piston's movement. Thus, the dynamic seal can be used as discussed herein with its advantages over conventional sealing engagements.

With the bellows 160*a* compressed to its solid stack height, there is no room for the bellow's convolutions to deform and fail. The pressure reaches between the bellow's external surfaces since no sealing is provided when convolutions are compressed against each other. Yet, there is no room for the convolutions to deform and yield. Regardless of future dome pressure increases, the upper bellow 160*a* does not compress further (since it is already fully compressed), and no oil flows to the lower bellow 160*b*. In this way, high-dome pressure does not transmit to the lower bellow 160*b*. It is expected that this gas lift valve 100 with the arrangement of two bellows 160*a-b* can operate up to 10 k PSI.

When compressed gas from the casing-tubing annulus (not illustrated) is injected from the surface, the gas enters the inlet 116 during operation of the valve 100. The compressed gas travels internally in the space between the housing 110 and the distal end 140 and enters the ancillary chamber 117. Here, the compressed gas acts against the lower cap 131*b* and against the external surfaces of the lower bellows 160*b*. This pressure then tends to push the bellow's convolutions against the internal dome chamber pressure inside the bellows 160*b*, which is communicated from the chamber 120 via the upper bellows 160*a* and oil in the piston's passages 135 and 137.

As long as the dome pressure's force is larger than the force created by the injection pressure, the valve piston 130 does not move, and the valve 100 remains closed. Once injection pressure increases sufficiently and the injection force acting on the lower bellow 160*b* becomes larger than the dome pressure, the piston 130 moves upward, and the gas-lift valve 100 opens. The external and internal pressure difference on the bellows 160*a-b* may partially contract the upper bellows 160*a* and extend the lower bellows 160*b* to move the piston's distal end 140 away from the sealing surface 115. Flow is now established through the valve 100, pushing the reverse check dart 150 to the open position and allowing gas to exit the valve 100 through the nose ports 118.

Increasing injection pressure and gas flow further compresses the lower bellow 160*b* as the piston 130 is forced upward. The internal oil travels from the lower bellow 160*b* to the upper bellow 160*a* via the internal passages 135 and 137. Finally, with enough force, the lower bellow 160*b* will fully compress to its solid stack height. In the open position shown in FIG. 8, the lower bellows 160*b* is fully compressed, and the upper bellows 160*b* is fully extended. The lower bellows 160*b* acts as a stop to the piston 130 and keeps the upper bellows 160*a* from over extending. (FIG. 9B shows a detail of the edge-welded bellows 160*a-b* and piston in an open condition.)

At this point, the bellow 160*b* is fully protected from deformation and damage since it acts as a piece of metal cylinder. The upper bellow 160*a* is now fully expanded to its free length. Regardless of further injection pressure increase, the oil stops flowing from the lower bellow 160*a* to the upper bellow 160*b*, and pressure does not transmit to the upper bellow 160*a* because movement is stopped by the stacked lower bellow 160*b*.

Bellow protection uses the full compression to solid stack height for both bellows 160*a-b* during valve operation when the valve 100 is open or closed. Full compression to solid height means that the bellows 160*a-b* are acting as a mechanical stop. When the valve 100 is fully closed, the upper bellow 160*a* is a mechanical stop. When the valve 100 is fully open, the lower bellow 160*b* is a mechanical stop in the opposite direction. The captive sliding seal 170 can therefore act dynamical as a sliding seal that can seal flow while allowing the bellows 160*b* to fully compress.

The gas lift valve 100 can be used for deepwater gas lift applications and applications involving very high injection pressures, although any number of implementations may benefit from the valve 100. The pressure rating of the gas lift valve 100 can be increased by using bellows 160 composed of an Inconel® alloy (e.g., Inconel® alloy 718) rather than a Monel® alloy. (INCONEL and MONEL are registered trademarks of Special Metals Corporation). Moreover, other techniques known in the art can help keep the bellows 160 from being damaged when operated with high differential pressure.

The foregoing description of preferred and other embodiments is not intended to limit or restrict the scope or applicability of the inventive concepts conceived of by the Applicants. With the benefit of the present disclosure, one skilled in the art will appreciate that features of one embodiment or arrangement disclosed herein can be combined with or exchanged for other embodiments or arrangements disclosed herein. Thus, the various captive sliding seal arrangements disclosed herein in FIGS. 6A through 7C can be used on either valve 100 of FIG. 3 or 8. Moreover, the gas lift valves 100 have been shown and described primarily as wireline-retrievable gas lift valves intended to install in a side pocket mandrel. As will be appreciated, this is not strictly necessary, and the disclosed valves 100 can be used as a wireline or tubing-retrievable apparatus and can be configured for use with any type of mandrel, even conventional mandrels having external mounts.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gas lift apparatus, comprising:

a housing having a chamber, an inlet, and an outlet and having a first seat disposed between the inlet and the outlet;

a piston movably disposed in the housing, the piston having a proximal end exposed to chamber pressure and having a distal end exposed to inlet pressure, the distal end sliding relative to the first seat and selectively sealing fluid communication through the first seat;

first and second edge-welded bellows disposed on the piston and separating the inlet pressure from the chamber pressure, the first edge-welded bellows fully compressing to a first stacked height at a point when the distal end seals fluid communication through the first seat, the second edge-welded bellows fully compressing to a second stacked height when the distal end is distanced away from the first seat, wherein the piston comprises an internal passage communicating a first interior of the first edge-welded bellows with a second interior of the second edge-welded bellows.

2. The apparatus of claim 1, wherein the first edge-welded bellows fully compressed to the first stacked height stops the sliding of the distal end relative to the first seat.

3. The apparatus of claim 1, further comprising a check valve disposed in the housing, the check valve permitting fluid communication from the inlet to the outlet and restricting fluid communication from the outlet to the inlet.

4. The apparatus of claim 1, wherein the first and second interiors communicate a pressure differential between the inlet pressure and the chamber pressure via the internal passage.

5. The apparatus of claim 1, wherein an incompressible fluid fills the first and second interiors and the internal passage.

6. The apparatus of claim 1, wherein the first edge-welded bellows comprises a plurality of edge-welded diaphragms being stacked on top of one another when fully compressed in the first stacked height.

7. The apparatus of claim 6, wherein the chamber comprises an end wall having a shape corresponding to one of the edge-welded diaphragms and having one end of the first edge-welded bellows affixed thereto; and wherein the piston comprises a shoulder having a shape corresponding to one of the edge-welded diaphragms and having one end of the first edge-welded bellows affixed thereto.

8. The apparatus of claim 1, wherein the first seat comprises an internal surface, and wherein the distal end of the piston comprises a seal disposed on an external surface of the distal end, the seal biased transversely to an axis of the piston and engaging the internal surface when disposed adjacent thereto.

9. The apparatus of claim 8, wherein the seal comprises a sealing ring and a resilient ring disposed in a groove defined around the external surface, the resilient ring biasing the sealing ring away from the external surface.

10. The apparatus of claim 8, wherein the seal comprises a spring-loaded cup seal having a lip biased away from the external surface.

11. The apparatus of claim 1, wherein the distal end comprises an external surface, and wherein the first seat comprises a seal disposed on an internal surface, the seal biased transversely to an axis of the piston and engaging the external surface of the distal end when disposed adjacent thereto.

12. The apparatus of claim 11, wherein the seal comprises a sealing ring and a resilient ring disposed in a groove defined around the internal surface, the resilient ring biasing the sealing ring away from the internal surface.

13. The apparatus of claim 11, wherein the seal comprises a spring-loaded cup seal having a lip biased away from the internal surface.

14. A gas lift apparatus, comprising:

a housing having a chamber, an inlet, and an outlet and having an internal surface disposed between the inlet and the outlet;

a piston movably disposed along an axis in the housing, the piston having a proximal end exposed to chamber pressure and having a distal end exposed to inlet pressure, the distal end having an external surface selectively movable relative to the internal surface;

at least one bellows disposed on the piston and separating the inlet pressure from the chamber pressure, the at least one bellows comprising a first bellows having a first interior and comprising a second bellows having a second interior; and a seal configured between the internal and external surfaces, the seal selectively sealing fluid communication from the inlet to the outlet and allowing the internal surface to slide relative to the external surface with the movement of the piston along the axis, wherein the first bellows compresses when the piston moves the seal in a sealed engagement between the internal and external surfaces, the first bellows when fully compressed stopping further movement of the piston toward the seal, wherein the second bellows compresses when the piston moves the seal in an unsealed engagement between the internal and external surfaces, the second bellows when fully compressed stopping further movement of the piston away relative to the seal, and wherein the piston comprises an internal passage communicating the first interior of the first bellows with the second interior of the second bellows.

15. The apparatus of claim 14, further comprising a check valve disposed in the housing, the check valve permitting fluid communication from the inlet to the outlet and restricting fluid communication from the outlet to the inlet.

16. The apparatus of claim 14, wherein the second bellows comprises:

a second edge-welded bellows disposed on the piston and separating the inlet pressure from the chamber pressure, the second edge-welded bellows fully compressing to a second stacked height when the external surface is distanced away from the internal surface in the unsealed engagement, the second edge-welded bellows when fully compressed stopping the movement of the piston in a second direction along the axis.

17. The apparatus of claim 14, wherein the first and second interiors communicate a pressure differential between the inlet pressure and the chamber pressure via the internal passage.

18. The apparatus of claim 14, wherein an incompressible fluid fills the first and second interiors and the internal passage.

19. The apparatus of claim 14, wherein the seal is disposed on the external surface of the distal end, the seal biased transversely to the axis of the piston and engaging the internal surface of the housing when disposed adjacent thereto.

20. The apparatus of claim 19, wherein the seal comprises a sealing ring and a resilient ring disposed in a groove defined around the external surface, the resilient ring biasing the sealing ring away from the external surface.

21. The apparatus of claim 19, wherein the seal comprises a spring-loaded cup seal having a lip biased away from the external surface.

22. The apparatus of claim 14, wherein the seal is disposed on the internal surface of the housing, the seal biased transversely to the axis of the piston and engaging the external surface of the distal end when disposed adjacent thereto.

23. The apparatus of claim 22, wherein the seal comprises a sealing ring and a resilient ring disposed in a groove defined around the internal surface of the housing, the resilient ring biasing the sealing ring away from the internal surface.

24. The apparatus of claim 22, wherein the seal comprises a spring-loaded cup seal having a lip biased away from the internal surface.

25. The apparatus of claim 14, wherein the first bellows comprises a first edge-welded bellows fully compressing to a first stacked height at a point when the seal in the sealed engagement seals fluid communication, the first edge-welded bellows when fully compressed stopping the movement of the piston in a first direction along the axis.

26. The apparatus of claim 25, wherein the first edge-welded bellows comprises a plurality of edge-welded diaphragms being stacked on top of one another when fully compressed in the first stacked height.

27. The apparatus of claim 25, wherein the chamber comprises an end wall having a shape corresponding to one of the edge-welded diaphragms and having one end of the first edge-welded bellows affixed thereto; and wherein the piston comprises a shoulder having a shape corresponding to one of the edge-welded diaphragms and having one end of the first edge-welded bellows affixed thereto.

28. The apparatus of claim 14, wherein the chamber comprises a dome chamber for containing compressed gas providing the chamber pressure.

29. The apparatus of claim 28, wherein the dome chamber comprises a seat, and wherein the piston comprises a seal element engaging the seat when the piston moves to a pinnacle position away from the seal.

30. The apparatus of claim 29, wherein the seal element engaged with the seat seals an amount of incompressible oil in a portion of the chamber around the first bellows.

31. A gas lift apparatus, comprising:

a housing having a dome chamber for containing compressed gas providing a chamber pressure, the dome chamber comprising a seat, the housing having an inlet, an outlet, and an internal surface disposed between the inlet and the outlet;

a piston movably disposed along an axis in the housing, the piston having a proximal end exposed to the chamber pressure and having a distal end exposed to inlet pressure, the distal end having an external surface selectively movable relative to the internal surface;

a bellows disposed on the piston and separating the inlet pressure from the chamber pressure; and a seal configured between the internal and external surfaces, the seal selectively sealing fluid communication from the inlet to the outlet and allowing the internal surface to slide relative to the external surface with the movement of the piston along the axis, wherein the bellows compresses when the piston moves the seal in a sealed engagement between the internal and external surfaces, the bellows when fully compressed stopping further movement of the piston toward the seal, and wherein the piston comprises a seal element engaging the seat of the dome chamber when the piston moves to a pinnacle position away from the seal.

32. The apparatus of claim 31, further comprising a check valve disposed in the housing, the check valve permitting fluid communication from the inlet to the outlet and restricting fluid communication from the outlet to the inlet.

33. The apparatus of claim 31, wherein the seal is disposed on the external surface of the distal end, the seal biased transversely to the axis of the piston and engaging the internal surface of the housing when disposed adjacent thereto.

34. The apparatus of claim 33, wherein the seal comprises:

a sealing ring and a resilient ring disposed in a groove defined around the external surface, the resilient ring biasing the sealing ring away from the external surface; or a spring-loaded cup seal having a lip biased away from the external surface.

35. The apparatus of claim 31, wherein the seal is disposed on the internal surface of the housing, the seal biased transversely to the axis of the piston and engaging the external surface of the distal end when disposed adjacent thereto.

36. The apparatus of claim 35, wherein the seal comprises:

a sealing ring and a resilient ring disposed in a groove defined around the internal surface of the housing, the resilient ring biasing the sealing ring away from the internal surface; or a spring-loaded cup seal having a lip biased away from the internal surface.

37. The apparatus of claim 31, wherein the bellows comprises an edge-welded bellows fully compressing to a stacked height at a point when the seal in the sealed engagement seals fluid communication, the edge-welded bellows when fully compressed stopping the movement of the piston in a first direction along the axis.

38. The apparatus of claim 37, wherein the edge-welded bellows comprises a plurality of edge-welded diaphragms being stacked on top of one another when fully compressed in the stacked height.

39. The apparatus of claim 37, wherein the chamber comprises an end wall having a shape corresponding to one of the edge-welded diaphragms and having one end of the edge-welded bellows affixed thereto; and wherein the piston comprises a shoulder having a shape corresponding to one of the edge-welded diaphragms and having one end of the edge-welded bellows affixed thereto.

* * * * *